252-105 AO 151
7/30/85 OR 4,532,064

United States Patent [19]

Boskamp

[11] Patent Number: 4,532,064

[45] Date of Patent: Jul. 30, 1985

[54] AQUEOUS ENZYME-CONTAINING COMPOSITIONS WITH IMPROVED STABILITY

[75] Inventor: Jelles V. Boskamp, Vlaardingen, Netherlands

[73] Assignee: Lever Brothers Company, New York, N.Y.

[21] Appl. No.: 597,942

[22] Filed: Apr. 9, 1984

[30] Foreign Application Priority Data

Apr. 26, 1983 [GB] United Kingdom ..... 8311314

[51] Int. Cl.[3] ..... C11D 7/42

[52] U.S. Cl. ..... 252/105; 252/135; 252/174.12; 252/174.19; 252/527; 252/DIG. 12; 252/DIG. 14

[58] Field of Search ..... 252/105, 135, 174.12, 252/174.19, DIG. 12, DIG.14, 527

[56] References Cited

U.S. PATENT DOCUMENTS 3,634,266 1/1972 Theile et al. ..... 252/132
4,238,345 12/1980 Guilbert ..... 252/174.12
4,243,543 1/1981 Guilbert et al. ..... 252/105
4,243,546 1/1981 Shaer ..... 252/174.12
4,261,868 4/1981 Hora et al. ..... 252/529
4,404,115 9/1983 Tai ..... 252/135

FOREIGN PATENT DOCUMENTS 1092036 12/1980 Canada .
2060485 3/1972 Fed. Rep. of Germany .
2079305 1/1982 United Kingdom .

*Primary Examiner*—Prince E. Willis
*Attorney, Agent, or Firm*—Milton L. Honig; James J. Farrell

[57] ABSTRACT

The invention pertains to aqueous, enzymatic liquid detergent compositions which contain an enzyme-stabilizing system. The replacement of polyols in known enzyme-stabilizing systems on the basis of mixtures of a polyol with a boron compound, such as boric acid or borax, or with a reducing salt, such as sodium sulphite, by a dicarboxylic acid, such as succinic acid, also provides for an effective, often superior enzyme-stabilizing system.

4 Claims, No Drawings

AQUEOUS ENZYME-CONTAINING COMPOSITIONS WITH IMPROVED STABILITY

The present invention relates to a stabilizing agent for aqueous enzyme-containing compositions.

It is well-known that enzymes, when included in aqueous media, often tend to lose their activity on storage over longer periods. This is particularly so when the aqueous media contain other ingredients as well, which may accelerate the deactivation of enzymes. Such is for instance often the case if the aqueous media are aqueous liquid detergent compositions.

In the prior art numerous proposals have been made concerning enzyme stabilizers in aqueous enzyme-containing liquid detergent compositions. Such enzyme-stabilizing systems often comprise a polyol, such as glycerol or sorbitol. Recently we have proposed as enzyme-stabilizing system a mixture of a polyol and a boron compound in our Dutch patent application No. 7711925, laid open to public inspection on May 3, 1978.

Another proposal is made in UK Patent Specification No. 2,021,142 (Economics Laboratories Inc.) to use a mixture of a polyol and a sulphur-containing anti-oxidant salt as enzyme-stabilizing mixture.

We have now found that the use of certain dicarboxylic acids instead of the polyol in the above systems equally provides for an enzyme-stabilisation effect. In some instances this effect is even superior to that which is obtained with the polyol-containing systems.

In its broadest aspect therefore the present invention relates to an aqueous enzyme-containing liquid composition comprising an enzyme-stabilizing system which comprises a mixture of:

(a) boric acid, boric oxide or an alkali metal borate, and/or a reducing alkali metal salt having an oxygenated sulphur anion $S_aO_b$ in which a and b are whole numbers from 1 to 8; and (b) a dicarboxylic acid of the general formula:

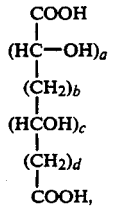

in which a, b, c, d are whole numbers from 0 to 4, the sum of a, b, c and d being from 0–4, or the alkali metal, ammonium, alkanolamine or alkaline earth metal salts thereof.

More particularly, the present invention relates to aqueous, liquid enzyne-containing detergent compositions incorporating the above mixture of (a) and (b) as enzyme-stabilizing system.

Component (a) can comprise, or consist of, boric acid, boric oxide or an alkali metal borate. Typical examples of alkali metal borates are sodium and potassium, ortho-, pyro- and meta-borates, -polyborates, and borax. Borax is the preferred alkali metal borate.

If component (a) comprises, or consists of, boric acid, boric oxide, or an alkali metal borate, the amount thereof ranges from 1 to 15, preferably from 3 to 10% by weight of the final aqueous enzyme-containing composition.

Component (a) can also comprise, or consist of, a reducing alkali metal salt having an oxygenated sulphur anion $S_aO_b$ in which a and b are whole numbers from 1 to 8. Typical examples of such reducing salts (which have an anti-oxidant effect) are sodium and potassium sulphites, -bisulphites, -metabisulphites and -thiosulphates. Sodium sulphite is the preferred reducing alkali metal salt.

If component (a) comprises, or consists of, the reducing alkali metal salt, the amount thereof ranges from 2 to 20, preferably from 5 to 15% by weight of the final aqueous, enzyme-containing composition.

Component (a) may also consist of mixtures of the various recited ingredients.

Component (b) consists of a dicarboxylic acid of the above general formula or mixtures of these acids; instead of the acids, the anhydrides can be used, or the alkali metal, ammonium, alkanolamine or alkaline earth metal salts of these acids. Typical examples of suitable dicarboxylic acids are oxalic acid, malonic acid, succinic acid, glutaric acid, adipic acid, tartronic acid, malic acid, tartaric acid, xylaric acid, arabimaric acid, glucaric acid, mucic acid and saccharic acid. In general, when a:c=0, the dicarboxylic acids of the general formula with b+d=0–2 are preferred over those with b+d=3–4, and if b+d=0, a+c=preferably 4. When a=c=0 and b=d=1, the corresponding unsaturated dicarboxylic acid, viz maleic or fumaric acid, may also be used.

The amount of the acid(s) used ranges from 0.5–15, preferably from 2–10% by weight of the final aqueous enzyme-containing composition. Succinic acid or saccharic acid or the alkali metal or alkanolamine salts thereof are the preferred compounds, since they provide for an enzyme-stabilizing effect which is equal or superior to the effect obtained with the corresponding polyol-containing systems. As alkanolamine salts the mono-, di- or triethanolamine salts can be used as well as the corresponding isopropanol amine salts. The salts of the acids can also be formed in situ in the final composition by neutralization with the required base.

The preferred enzyme-stabilizing system according to the present invention comprises a mixture of sodium sulphite, borax and disodium succinate.

The aqueous liquid compositions in which the stabilizing systems of the invention are incorporated are preferably aqueous, liquid enzymatic detergents compositions further comprising as essential ingredients enzymes, and active detergents.

The enzymes to be incorporated can be proteolytic, lypolytic, amylolytic and cellulolytic enzymes as well as mixtures thereof. They may be of any suitable origin, such as vegetable, animal, bacterial, fungal and yeast origin. However, their choice is governed by several factors such as pH activity and/or stability optima, thermosta- bility, stability versus active detergents, builders and so on. In this respect bacterial or fungal enzymes are preferred, such as bacterial amylases and proteases, and fungal cellulases. Although the liquid compositions of the present invention may have a near-neutral pH value, the present invention is of particular benefit for enzymatic liquid detergents with a pH of 7.5 or above, especially those incorporating bacterial proteases of which the pH-optima lie in the range between 8.0 and 11.0, but it is to be understood that enzymes with a somewhat lower or higher pH-optimum can still be used in the compositions of the invention, benefiting from it.

Suitable examples of proteases are the subtilisins which are obtained from particular strains of B. subtilis and B. licheniformis, such as the commercially available subtilisins Maxatase® (ex Gist-Brocades N.V., Delft, Holland) and Alcalase® (ex Novo Industri A/S, Copenhagen, Denmark).

As stated above, the present invention is of particular benefit for enzymatic liquid detergents incorporating enzymes with pH-activity and/or stability optima of above 8.0, such enzymes being commonly called high-alkaline enzymes.

Particularly suitable are proteases obtained from strains of Bacillus, having maximum activity throughout the pH-range of 8–12, developed and sold by Novo Industri A/S under the registered trade name of Esperase® and Savinase®.

The preparation of this enzyme and analogous enzymes is described in British Patent Specification No. 1,243,784 of Novo.

High-alkaline amylases and cellulase can also be used, e.g. alpha-amylases obtained from a special strain of B. licheniformis, described in more detail in British Patent Specification No. 1,296,839 (Novo).

The enzymes can be incorporated in any suitable form, e.g. as a granulate (marumes, prills etc.), or as a liquid concentrate. The granulate form has often advantages.

The amount of enzymes present in the liquid composition may vary from 0.001 to 10% by weight, and preferably from 0.01 to 5% by weight.

The liquid detergent compositions of the invention furthermore comprise as essential ingredient an active detergent material, which may be an alkali metal or alkanol amine soap or a $C_{10}$–$C_{24}$ fatty acid, including polymerized fatty acids, or an anionic, nonionic, cationic, zwitterionic or amphoteric synthetic detergent material, or mixtures of any of these.

Examples of anionic synthetic detergents are salts (including sodium, potassium, ammonium, and substituted ammonium salts, such as mono-, di- and triethanolamine salts) of $C_9$–C20 alkylbenzene sulphonates, $C_8$–$C_{22}$ primary or secondary alkane sulphonates, $C_8$–$C_{24}$ olefin sulphonates, sulphonated polycarboxylic acids, prepared by sulphonation of the pyrolyzed product of alkaline earth metal citrates, e.g. as described in British Patent Specification No. 1,082,179, $C_8$–$C_{22}$ alkyl sulphates, $C_8$–$C_{24}$ alkylpolyglycolether sulphates (containing up to 10 moles of ethylene oxide); further examples are described in "Surface Active Agents and Detergents" (Vol. I and II) b Schwartz, Perry and Berch.

Examples of nonionic synthetic detergents are the condensation products of ethylene oxide, propylene oxide and/or butyleneoxide with $C_8$–$C_{18}$ alkylphenols, $C_8$–$C_{18}$ primary or secondary aliphatic alcohols, $C_8$–$C_{18}$ fatty fatty acid amides; further examples of nonionics include tertiary amine oxides with one $C_8$–$C_{18}$ alkyl chain and two $C_{1-3}$ alkyl chains. The above reference also describes further examples of nonionics.

The average number of molecules of ethylene oxide and/or propylene oxide present in the above nonionics varies from 1–30; mixtures of various nonionics, including mixtures of nonionics with a lower and a higher degree of alkoxylation, may also be used.

Examples of cationic detergents are the quaternary ammonium compounds such as alkyldimethylammonium halogenides, but such cationics are less preferred for inclusion in enzymatic detergent compositions.

Examples of amphoteric or zwitterionic detergents are N-alkylamino acids, sulphobetaines, condensation products of fatty acids with protein hydrolysates, but owing to their relatively hight costs they are usually used in combination with an anionic or a nonionic detergent. Mixtures of the various types of active detergents may also be used, and preference is given to mixtures of an anionic and a nonionic detergent active. Soaps (in the form of their sodium, potassium, and substituted ammonium salts) of fatty acids may also be used, preferably in conjunction with an anionic and/or a nonionic synthetic detergent.

The amount of the active detergent material varies from 1 to 60%, preferably from 2–40 and especially preferably from 5–25%; when mixtures of e.g: anionics and nonionics are used, the relative weight ratio varies from 10:1 to 1:10, preferably from 6:1 to 1:6. When a soap is also incorporated, the amount thereof is from 1–40% by weight.

The liquid compositions of the invention may further contain up to 60% of a suitable builder, such as sodium, potassium and ammonium or substituted ammonium pyro- and tripolyphosphates, -ethylenediamine tetraacetates, -nitrilotriacetates, -etherpolycarboxylates, -citrates, -carbonates, -orthophosphates, zeolites, carboxymethyloxysuccinate, etc. Particularly preferred are the polyphosphate builder salts, nitrilotriacetates, citrates, zeolites, and mixtures thereof. In general the builders are present in an amount of 1–60, preferably 5–50%, and particularly preferably 5–30% by weight of the final composition.

The amount of water present in the detergent compositions of the invention varies from 5 to 70% by weight.

Other conventional materials may also be present in the liquid detergent compositions of the invention, for example soil-suspending agents, hydrotropes, corrosion inhibitors, dyes, perfumes, silicates, optical brighteners, suds depressants such as silicones, germicides, anti-tarnishing agents, opacifiers, fabric softening agents, oxygen-liberating bleaches such as hydrogen peroxide, sodium perborate or percarbonate, disperisophthalic anhydride, with or without bleach precursors, buffers and the like. When the composition contains a builder, it may sometimes be advantageous to include a suspension stabilizer in the composition to provide a satisfactory phase-stability. Such stabilizers include natural or synthetic polymers.

Suitable examples of such suspension stabilizers are polyacrylates, copolymers of maleic anhydride and ethylene or vinylmethylether, and polymers of acrylic acid, cross-linked with not more than 10% of a vinyl-group containing cross-linking agent, e.g. polymers of acrylic acid, cross-linked with about 1% of a polyallyl ether of sucrose having an average of about 5.8 alkyl-groups for each sucrose molecule. Examples of the latter are commercially available products, available under the registered trade name of Carbopol of B. F. Goodrich Co. Ltd.

In general, if a suspension stabilizer is required, it will be included in an amount of 0.1–2, usually 0.25–1% by weight of the final composition.

The invention will now be further illustrated by way of Example. In the examples, all the percentages are percentages by weight of the final composition.

The pH of the final composition is near neutral, preferably 7.5 or higher, and is, if necessary, buffered to a value within that range by addition of a suitable buffer system. The pH of the wash liquor, when using the composition, is about 1 pH unit higher than the above values at an in-use concentration of about 1%.

EXAMPLE 1

| | % by weight |
|---|---|
| Sodium dodecylbenzene sulphonate | 5 |
| $C_{13}$-$C_{15}$ linear primary alcohol condensed with 7 moles of ethylene oxide, which is a mixture of ethylene and propylene oxide in a weight ratio of 92:8 | 2 |
| Pentasodium triphosphate (anhydrous) | 21 |
| Sodium carboxymethyl cellulose | 0.2 |
| Carbopol ® 941 (a polymer of acrylic acid crosslinked with about 1% of a polyalkylether of sucrose having an average of about 5.8 alkyl groups for each sucrose molecule) | 0.4 |
| Fluorescer | 0.1 |
| Alcalase ® marumes (activity 1.5 Anson unit/g) | 0.7 |
| Enzyme stabilizer or dicarboxylic acid | x |
| Borax | y |
| Sodium sulphite (anhydrous) | z |
| Water to | 100.0% |
| pH | 7.5 |

x, y and z were varied, yielding a series of compositions 1-5.

The products were stored at 37° C. and the residual enzymatic activity (RA) was determined at weekly intervals.

The following results were obtained:

| | | | |
|---|---|---|---|
| Composition 1: | x = 5%<br>y = 3.5%<br>z = 8.0% | Succinic acid | RA after 8 weeks: 100% |

The same composition, but with 5% glycerol instead of succinic acid, had an RA after 8 weeks of 80%. The system, where y=z=0%, had an RA of 36% after 1 week, and when x=z=0%, an RA of 1% after 1 week.

| | | | |
|---|---|---|---|
| Composition 2: | x = 5%<br>y = 3.5%<br>z = 0 | Succinic acid | RA after 4 weeks 45%. |

The same composition, but with 5% glycerol instead of succinic acid, had an RA after 4 weeks of 27%.

The same composition, but with 5% adipic or glutaric acid instead of succinic acid, had an RA after one week of 40%. (The glutaric acid was added as glutaric acid anhydride).

| | | |
|---|---|---|
| Composition 3: | x = 2% or 5%<br>y = 0<br>z = 8% | RA after 4 weeks = 100% |
| Composition 4: | x = 1%<br>y = 0<br>z = 8% | RA after 4 weeks = 75% |

For comparison, the same products but with 2.5 or 5% glycerol instead of succinic acid and 7.5% sodium sulphite:

x=2.5 or 5
y=0
x=7.5 had an RA after 4 weeks of 60%; the same composition but with only 7.5% sulphite:

x=0
y=0
z=7.5 had an RA of 32% after 1 week.

| | | |
|---|---|---|
| Composition 5: | x = 5% of saccharic acid<br>y = 3.5%<br>z = 8% | RA after 8 weeks: 80% |

The same composition, but with 5% of glycerol instead of saccharic acid, had an RA after 8 weeks of 80%.

| | | |
|---|---|---|
| Composition 6: | x = 5% of malonic acid<br>y = 3.5%<br>z = 0 | RA after 4 weeks: 44%. |
| Composition 7: | x = 5% maleic acid<br>y = 3.5%<br>z = 0 | RA after 4 weeks: 46%. |

I claim:

1. An aqueous, enzymatic liquid detergent composition comprising, in an aqueous liquid medium, as essential ingredients, from 1-60% by weight of an active detergent material selected from the group consisting of soap, anionic, nonionic, cationic, zwitterionic and amphoteric surfactants and mixtures thereof, from 1-60% by weight of a detergent builder, from 0.001-10% by weight of bacterial or fungal enzymes and a stabilizing system for said enzymes, wherein the stabilizing system consisting essentially of a mixture of (A) an inorganic compound selected from the group consisting of boric acid, boric oxide, alkalimetal borate, a reducing alkalimetal salt having an oxygenated sulphur anion $S_aO_b$, in which a and b are whole numbers from 1 to 8, and mixtures thereof, and (B) a dicarboxylic acid of the general formula $$COOH—(CHOH)_a—(CH_2)_b—(CHOH)_c—(CH_2)_d—COOH$$

in which a, b, c and d are whole numbers from 0-4, the sum of a, b, c and d being from 0-4, whereby, when a=c=0 and b=c=1, the corresponding dicarboxylic acid may also be unsaturated, or the alkalimetal, ammonium, alkanolamine or alkaline earth metal salts thereof, whereby the amount of (A) is from 1-15% by weight for the boron compounds and from 2-20% by weight for the reducing alkalimetal salt and the amount of (B) is from 0.5-15% by weight.

2. A composition according to claim 1, wherein the amount of (A) is from 3-10% by weight for the boron compound or 5-15% by weight for the reducing alkalimetal salt and the amount of (B) is from 2-10% by weight.

3. A composition according to claim 1, wherein (A) consists of borax, sodium sulphite or a mixture thereof and (B) consists of succinic or saccharic acid.

4. A composition according to claim 1, having a pH of 7.5 or above, and comprising 5-25% by weight of a mixture of an anionic and a nonionic synthetic detergent in a weight ratio of 6:1 to 1:6, 5-30% of a polyphosphate builder salt, 0.01 to 5% by weight of proteolytic or amylolytic enzymes having a pH-optimum above 8, and an enzyme stabilizing system consisting of 3-10% by weight of borax, 5-15% by weight of sodium sulphite and 2-10% by weight of disodiumsuccinate.

* * * * *